US009430966B2

(12) United States Patent
Lee et al.

(10) Patent No.: US 9,430,966 B2
(45) Date of Patent: Aug. 30, 2016

(54) ORGANIC LIGHT EMITTING DISPLAY DEVICE AND METHOD OF DRIVING THE SAME

(71) Applicant: Samsung Display Co., LTD., Yongin, Gyeonggi-Do (KR)

(72) Inventors: Gi-Chang Lee, Hwaseong-si (KR); Won-Jun Lee, Seongnam-si (KR); Ji-Yeon Yoon, Busan (KR)

(73) Assignee: SAMSUNG DISPLAY CO., LTD. (KR)

( * ) Notice: Subject to any disclaimer, the term of this patent is extended or adjusted under 35 U.S.C. 154(b) by 362 days.

(21) Appl. No.: 14/202,599

(22) Filed: Mar. 10, 2014

(65) Prior Publication Data

US 2015/0070407 A1 Mar. 12, 2015

(30) Foreign Application Priority Data

Sep. 12, 2013 (KR) ..... 10-2013-0109620

(51) Int. Cl.

| | |
|---|---|
| ***G09G 5/10*** | (2006.01) |
| ***G09G 3/32*** | (2016.01) |
| *G09G 3/20* | (2006.01) |

(52) U.S. Cl.

CPC ..... *G09G 3/3233* (2013.01); *G09G 3/2025* (2013.01); *G09G 2300/0852* (2013.01); *G09G 2300/0861* (2013.01); *G09G 2310/061* (2013.01)

(58) Field of Classification Search

None

See application file for complete search history.

(56) References Cited

U.S. PATENT DOCUMENTS

| | | | | |
|---|---|---|---|---|
| 8,018,449 | B2 | 9/2011 | Jeon | |
| 2009/0058772 | A1 | 3/2009 | Lee | |
| 2010/0156963 | A1* | 6/2010 | Shiomi | G09G 3/3648 345/691 |
| 2011/0205250 | A1 | 8/2011 | Yoo et al. | |
| 2012/0050350 | A1 | 3/2012 | Matsui | |
| 2012/0105605 | A1* | 5/2012 | Nam | G09G 3/003 348/51 |
| 2012/0147070 | A1 | 6/2012 | Segawa et al. | |
| 2012/0169707 | A1 | 7/2012 | Ebisuno et al. | |

FOREIGN PATENT DOCUMENTS

| | | | |
|---|---|---|---|
| JP | 2003288055 | B2 | 10/2003 |
| JP | 2007011215 | A | 1/2007 |

OTHER PUBLICATIONS

Search Report for Application No. LA-201305-376-1 dated Jun. 17, 2013.

* cited by examiner

*Primary Examiner* — Nicholas Lee

(74) *Attorney, Agent, or Firm* — Cantor Colburn LLP

(57) ABSTRACT

A method of driving an organic light emitting display device includes: dividing one frame into one blank frame and sub-frames; determining whether a data signal to be applied to a pixel circuit of the organic light emitting display device is a data signal of a high gray-level region or a data signal of a low gray-level region based on a predetermined reference gray-level; applying the data signal to the pixel circuit in all of the sub-frames when the data signal is the data signal of the high gray-level region; and applying a first setting data signal corresponding to a gray-level higher than the reference gray-level to the pixel circuit in some of the sub-frames, and applying a second setting data signal corresponding to a zeroth gray-level to the pixel circuit in other sub-frames among the sub-frames when the data signal is the data signal of the low gray-level region.

20 Claims, 9 Drawing Sheets

ORGANIC LIGHT EMITTING DISPLAY DEVICE AND METHOD OF DRIVING THE SAME

This application claims priority to Korean Patent Applications No. 10-2013-0109620, filed on Sep. 12, 2013, and all the benefits accruing therefrom under 35 U.S.C. §119, the content of which are incorporated by reference herein in its entirety.

BACKGROUND

1. Field

Exemplary embodiments relate generally to a display device. More particularly, embodiments of the invention relate to an organic light emitting display device and a method of driving the organic light emitting display device.

2. Description of the Related Art

Recently, an organic light emitting display device is one of the most widely used types of flat display devices as a size of an electronic device becomes smaller and power consumption thereof becomes lowered. Generally, the organic light emitting display device implements (e.g., displays) a specific gray-level using an analog driving technique, in which a driving transistor controls a current flowing through an organic light emitting diode based on an analog driving voltage (e.g., a voltage stored in a storage capacitor of each pixel circuit). Alternatively, the organic light emitting display device may implement a specific gray-level using a digital driving technique that displays one frame by displaying a plurality of sub-frames. That is, the digital driving technique divides one frame into a plurality of sub-frames, differently sets each emission time of the sub-frames (e.g., by a factor of 2), and implements a specific gray-level using a sum of respective emission times of the sub-frames.

SUMMARY

Exemplary embodiments of the invention provide a method of driving an organic light emitting display device, in which an image stain related to a relatively low gray-level as well as an image stain related to a relatively high gray-level is prevented while driving the organic light emitting display device based on an analog driving technique.

Exemplary embodiments of the invention provide an organic light emitting display device capable of preventing an image stain related to a relatively low gray-level as well as an image stain related to a relatively high gray-level while operating based on an analog driving technique.

According to an exemplary embodiment, a method of driving an organic light emitting display device includes: dividing one frame into one blank frame and a plurality of sub-frames; determining whether a data signal to be applied to a pixel circuit of the organic light emitting display device is a data signal of a high gray-level region or a data signal of a low gray-level region based on a predetermined reference gray-level; applying the data signal to the pixel circuit in all of the sub-frames when the data signal is the data signal of the high gray-level region; and applying a first setting data signal corresponding to a gray-level higher than the reference gray-level to the pixel circuit in some of the sub-frames, and applying a second setting data signal corresponding to the zeroth gray-level to the pixel circuit in other sub-frames among the sub-frames when the data signal is the data signal of the low gray-level region, where the organic light emitting display device implements a gray-level corresponding the data signal by controlling a current flowing through an organic light emitting diode of each pixel circuit thereof based on the data signal, which is an analog driving voltage.

In an exemplary embodiment, the gray-level corresponding to the data signal may be implemented using an average value of respective sub-frame gray-levels which are displayed in the sub-frames.

In an exemplary embodiment, the first setting data signal may be substantially equally set for each of the sub-frames when the data signal is the data signal of the low gray-level region.

In an exemplary embodiment, the first setting data signal may be unequally set for each of the sub-frames when the data signal is the data signal of the low gray-level region.

In an exemplary embodiment, a scan operation and an emission operation for the pixel circuit may be performed in the sub-frames.

In an exemplary embodiment, the sub-frames may have substantially a same time length as each other.

In an exemplary embodiment, the sub-frames may have different time lengths from each other.

In exemplary embodiments, the emission operation for the pixel circuit may be performed in a sequential emission manner in each of the sub-frames.

In exemplary embodiments, the emission operation for the pixel circuit may be performed in a simultaneous emission manner in each of the sub-frames.

In exemplary embodiments, an initialization operation and a threshold voltage compensation operation for the pixel circuit may be performed in the blank frame.

In exemplary embodiments, the blank frame may be arranged prior to the sub-frames in the one frame.

According to another exemplary embodiment, an organic light emitting display device may include a display panel including a plurality of pixel circuits, a scan driving unit configured to provide a scan signal to the pixel circuits, a data driving unit configured to provide a data signal to the pixel circuits, an emission control unit configured to provide an emission control signal to the pixel circuits, a power unit configured to provide a high power voltage and a low power voltage to the pixel circuits, a timing control unit configured to divide one frame into one blank frame and a plurality of sub-frames, and configured to control the scan driving unit, the data driving unit and the emission control unit to implement a gray-level corresponding to the data signal using an average value of respective sub-frame gray-levels displayed in the sub-frames, and a frame setting unit configured to set a time length and a quantity of the sub-frames, a reference gray-level for determining whether the data signal is a data signal of a high gray-level region or a data signal of a low gray-level region, and first and second setting data signals for the data signal of the low gray-level region.

In an exemplary embodiment, the data driving unit may apply the data signal to the pixel circuits in all of the sub-frames when the data signal is the data signal of the high gray-level region.

In an exemplary embodiment, the data driving unit may apply the first setting data signal corresponding to a gray-level higher than the reference gray-level to the pixel circuits in some of the sub-frames, and may apply the second setting data signal corresponding to the zeroth gray-level to the pixel circuits in other sub-frames among the sub-frames when the data signal is the data signal of the low gray-level region.

In an exemplary embodiment, the emission control unit may sequentially apply the emission control signal to the pixel circuits when an emission operation for the pixel circuits is performed in each of the sub-frames.

In an exemplary embodiment, the emission control unit may simultaneously apply the emission control signal to the pixel circuits when an emission operation for the pixel circuits is performed in each of the sub-frames.

In an exemplary embodiment, the frame setting unit may set respective time lengths of the sub-frames to be equal.

In an exemplary embodiment, the frame setting unit may set respective time lengths of the sub-frames to be unequal.

In an exemplary embodiment, the frame setting unit may equally set the first setting data signal for each of the sub-frames when the data signal is the data signal of the low gray-level region.

In an exemplary embodiment, the frame setting unit may unequally set the first setting data signal for each of the sub-frames when the data signal is the data signal of the low gray-level region.

In such embodiments, a method of driving an organic light emitting display device according to exemplary embodiments, where the organic light emitting display device is driven based on an analog driving technique, may effectively prevent an image stain related to a relatively low gray-level as well as an image stain related to a relatively high gray-level, and may secure a sufficient timing margin for performing a display operation by dividing one frame into one blank frame and a plurality of sub-frames and by implementing a gray-level corresponding to a data signal using an average value of respective sub-frame gray-levels that are displayed in the sub-frames.

In such embodiments, an organic light emitting display device according to exemplary embodiments may display (e.g., output) a high-quality image having a high-resolution.

BRIEF DESCRIPTION OF THE DRAWINGS

Illustrative, non-limiting exemplary embodiments will be more clearly understood from the following detailed description taken in conjunction with the accompanying drawings, in which.

DETAILED DESCRIPTION

Figure 1:
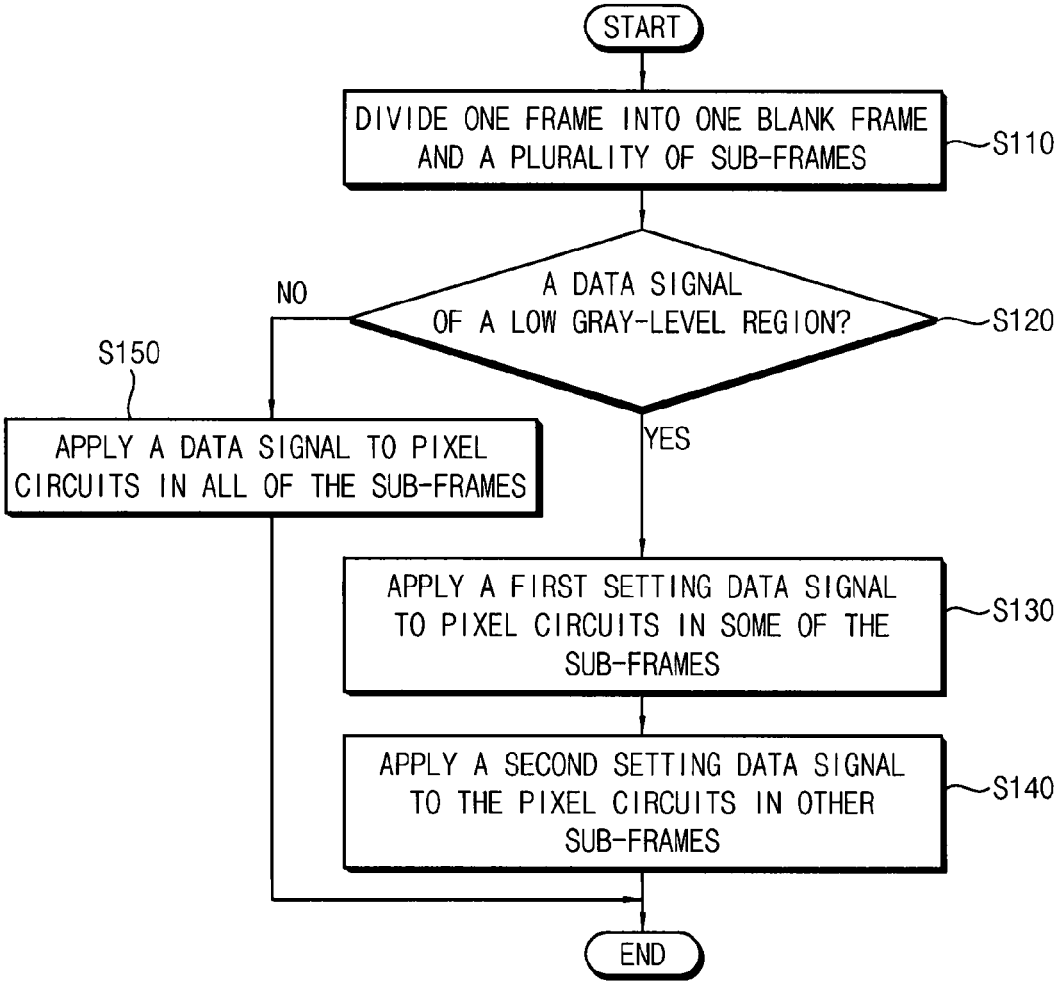
FIG. 1 is a flow chart illustrating an exemplary embodiment of a method of driving an organic light emitting display device, according to the invention.

Various exemplary embodiments will be described more fully hereinafter with reference to the accompanying drawings, in which some exemplary embodiments are shown. The invention may, however, be embodied in many different forms and should not be construed as limited to the exemplary embodiments set forth herein. Rather, these exemplary embodiments are provided so that this disclosure will be thorough and complete, and will fully convey the scope of the invention to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the invention. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means in an acceptable range of deviation for the particular value as determined by one of ordinary skill in the art, considering the measurement in question and the error associated with measurement of the particular quantity (i.e., the limitations of the measurement system). For example, "about" can mean in one or more standard deviations, or in ±30%, 20%, 10%, 5% of the stated value.

Unless otherwise defined, all terms (including technical and scientific terms) used herein have the same meaning as commonly understood by one of ordinary skill in the art to which the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

Figure 2:
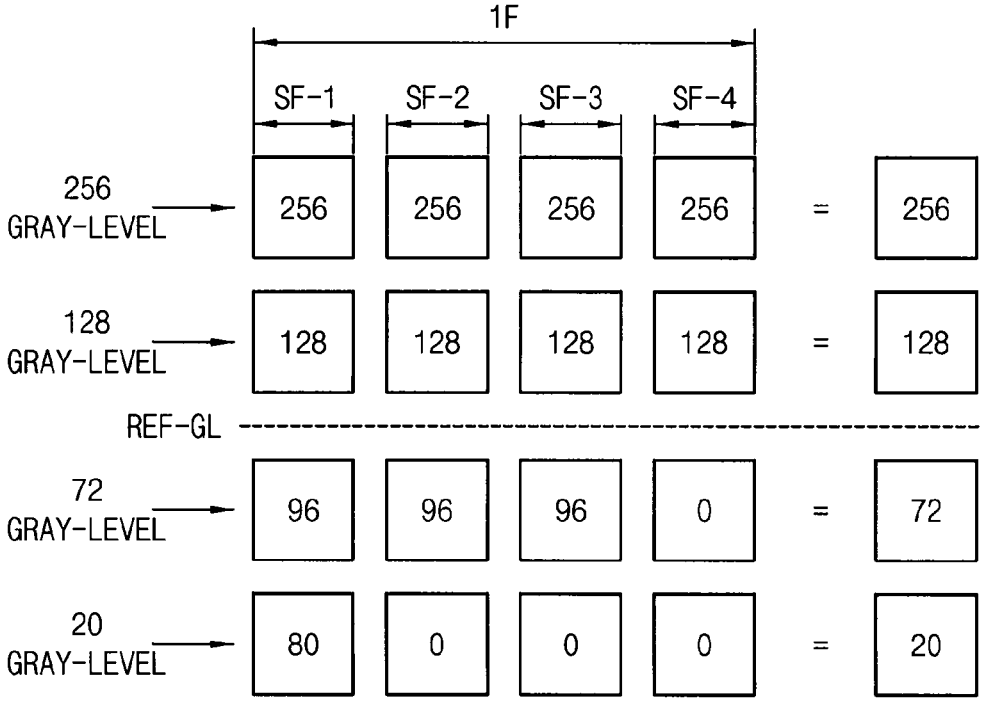
FIG. 2 is a diagram illustrating a gray-level corresponding to a data signal in an exemplary embodiment of an organic light emitting display device that employs the method of FIG. 1.

FIG. 1 is a flow chart illustrating an exemplary embodiment of a method of driving an organic light emitting display device, according to the invention. FIG. 2 is a diagram illustrating a gray-level corresponding to a data signal implemented by the method of FIG. 1.

Referring to FIGS. 1 and 2, an exemplary embodiment of a method of driving an organic light emitting display device may be a method of driving an organic light emitting display device that implements a specific gray-level corresponding to a data signal by controlling a current flowing through an organic light emitting diode of each pixel circuit based on the data signal (e.g., an analog driving voltage). In such an embodiment, the method of driving an organic light emitting display device may include dividing one frame 1F for displaying an image into one blank frame and a plurality of sub-frames SF-1 through SF-4 (S110), and checking or determining whether a data signal is a data signal of a low gray-level region based on a predetermined reference gray-level REF-GL (S120). In such an embodiment, the reference gray-level REF-GL may correspond to a reference value that is set by a user (or, designer) to determine whether the data signal is the data signal of the high gray-level region or the data signal of the low gray-level region. The reference gray-level REF-GL may be a gray-level that is set to determine whether the data signal is a data signal of a high gray-level region or a data signal of a low gray-level region. In an exemplary embodiment, when the data signal is a data signal of the low gray-level region, the method of FIG. 1 may be performed by applying a first setting data signal to pixel circuits in some of the sub-frames SF-1 through SF-4, where the first setting data signal corresponds to a gray level higher than the reference gray-level REF-GL (S130), and applying a second setting data signal to the pixel circuits in other sub-frames among the sub-frames SF-1 through SF-4, e.g., remaining sub-frames among the sub-frames SF-1 through SF-4, where the second setting data signal corresponds to the zeroth gray-level (S140). In such an embodiment, when the data signal is a data signal of the high gray-level region, the data signal may be applied to the pixel circuits in all of the sub-frames SF-1 through SF-4 (S150).

In an exemplary embodiment, the method of FIG. 1 may include dividing one frame 1F for displaying an image into one blank frame and a plurality of sub-frames, e.g., first through fourth sub-frames SF-1 through SF-4 as shown in FIG. 2 (S110). Although four sub-frames SF-1 through SF-4 are illustrated in FIG. 2, the number of the sub-frames SF-1 through SF-4 constituting one frame 1F is not limited thereto. In an exemplary embodiment, an initialization operation and a threshold voltage compensation operation are performed on the pixel circuits in the blank frame. In such an embodiment, a scan operation and an emission operation are performed on the pixel circuits in the sub-frames SF-1 through SF-4. In such an embodiment, the blank frame is arranged prior to the sub-frames SF-1 through SF-4 in one frame 1F. In an exemplary embodiment, as illustrated in FIG. 2, the sub-frames SF-1 through SF-4 may have a substantially the same time length as each other. In another exemplary embodiment, the sub-frames SF-1 through SF-4 may have different time lengths from each other. In an exemplary embodiment, as described above, the method of FIG. 1 may use a technique similar to a digital driving technique, that is, a technique in which one frame 1F is divided into one blank frame and a plurality of sub-frames SF-1 through SF-4 for the organic light emitting display device that employs an analog driving technique, where a specific gray-level corresponding to a data signal are implemented by controlling a current flowing through an organic light emitting diode of each pixel circuit based on the data signal (e.g., an analog driving voltage).

In such an embodiment, the method of FIG. 1 may include checking or determining whether the data signal is a data signal of the low gray-level region based on the reference gray-level REF-GL (S120). In one exemplary embodiment, for example, as illustrated in FIG. 2, when a gray-level corresponding to a data signal is higher than the reference gray-level REF-GL (e.g., the 128th gray-level or the 256th gray-level in FIG. 2), the data signal may be determined as a data signal of the high gray-level region. In such an embodiment, when a gray-level corresponding to a data signal is lower than the reference gray-level REF-GL (e.g., the 72nd gray-level or the 20th gray-level in FIG. 2), the data signal may be determined as a data signal of the low gray-level region. In such an embodiment, the reference gray-level may be greater than 72nd gray-level and less than 80th or 128th gray-level. Thus, the method of FIG. 1 may include implementing a gray-level corresponding to a data signal of the high gray-level region and a gray-level corresponding to a data signal of the low gray-level region in different ways to effectively prevent an image stain related to a relatively low gray-level. The method of FIG. 1 may include implementing a gray-level corresponding to a data signal of the high gray-level region (e.g., a relatively high analog driving voltage) by directly applying the data signal of the high gray-level region to the pixel circuits as the image stain may not occur due to the data signal of the high gray-level region. The method of FIG. 1 may include implementing a gray-level corresponding to a data signal of the low gray-level region (e.g., a relatively low analog driving voltage) by not applying the data signal of the low gray-level region to the pixel circuits in an organic light emitting display device where the data signal of the low gray-level region may cause the image stain.

As illustrated in FIG. 2, in such an embodiment, when a data signal is the data signal of the low gray-level region, the first setting data signal is applied to the pixel circuits in some of the sub-frames SF-1 through SF-4, where the first setting data signal corresponds to a gray level higher than the reference gray-level REF-GL (S130), and the second setting data signal is applied to the pixel circuits in other sub-frames among the sub-frames SF-1 through SF-4, where the second setting data signal corresponds to the zeroth gray-level (S140). As a result, a gray-level corresponding to the data signal of the low gray-level region may be implemented using an average value of respective sub-frame gray-levels that are displayed in the sub-frames SF-1 through SF-4. In one exemplary embodiment, for example, the 72nd gray-level corresponding to the data signal of the low gray-level region may be implemented by applying the first setting data signal corresponding to the 96th gray-level to the pixel circuits in the first sub-frame SF-1, the second sub-frame SF-2 and the third sub-frame SF-3, and by applying the second setting data signal corresponding to the zeroth gray-level to the pixel circuits in the fourth sub-frame SF-4. That is, the 72nd gray-level corresponding to the data signal of the low gray-level region may be implemented using an average value of respective sub-frame gray-levels (i.e., (96+96+96+0)/4=72) where the number of the 96th sub-frame gray-level is 3 and the number of the zeroth sub-frame gray-level is 1. In such an embodiment, the 20th gray-level corresponding to the data signal of the low gray-level region may be implemented by applying the first setting data signal corresponding to the 80th gray-level to the pixel circuits in the first sub-frame SF-1, and by applying the second setting data signal corresponding to the zeroth gray-level to the pixel circuits in the second sub-frame SF-2, the third sub-frame SF-3 and the fourth sub-frame SF-4. That is, the 20th gray-level corresponding to the data signal of the low gray-level region may be implemented using an average value of respective sub-frame gray-levels (i.e., (80+0+0+0)/4=20) where the number of the 80th sub-frame gray-level is 1 and the number of the zeroth sub-frame gray-level is 3.

In such an embodiment, when a data signal is the data signal of the high gray-level region, the data signal is applied to the pixel circuits in all of the sub-frames SF-1 through SF-4 (S150). As a result, a gray-level corresponding to the data signal of the high gray-level region may be implemented using an average value of respective sub-frame gray-levels that are displayed in the sub-frames SF-1 through SF-4. In one exemplary embodiment, for example, the 256th gray-level corresponding to the data signal of the high gray-level region may be implemented by applying the data signal corresponding to the 256th gray-level to the pixel circuits in the first sub-frame SF-1, the second sub-frame SF-2, the third sub-frame SF-3 and the fourth sub-frame SF-4. That is, the 256th gray-level corresponding to the data signal of the high gray-level region may be implemented using an average value of respective sub-frame gray-levels (i.e., (256+256+256+256)/4=256) where the number of the 256th sub-frame gray-level is 4. In such an embodiment, the 128th gray-level corresponding to the data signal of the high gray-level region may be implemented by applying the data signal corresponding to the 128th gray-level to the pixel circuits in the first sub-frame SF-1, the second sub-frame SF-2, the third sub-frame SF-3 and the fourth sub-frame SF-4. That is, the 128th gray-level corresponding to the data signal of the high gray-level region may be implemented using an average value of respective sub-frame gray-levels (i.e., (128+128+128+128)/4=128) where the number of the 128th sub-frame gray-level is 4.

Generally, a display panel of the organic light emitting display device includes first through k-th pixel circuits, where k is an integer greater than or equal to 2. For convenience of description, an exemplary embodiment, where a first data signal to be applied to the first pixel circuit in one frame 1F is the data signal of the low gray-level region, and a second data signal to be applied to the second pixel circuit in one frame 1F is the data signal of the high gray-level region, will be described. In such an embodiment, a gray-level corresponding to the first data signal may be implemented using an average value of respective sub-frame gray-levels that are displayed in the sub-frames SF-1 through SF-4 by applying the first setting data signal corresponding to a gray-level higher than the reference gray-level REF-GL to the first pixel circuit in some of the sub-frames SF-1 through SF-4, and by applying the second setting data signal corresponding to the zeroth gray-level to the first pixel circuit in other sub-frames among the sub-frames SF-1 through SF-4. In such an embodiment, a gray-level corresponding to the second data signal may be implemented using an average value of respective sub-frame gray-levels that are displayed in the sub-frames SF-1 through SF-4 by applying the second data signal to the second pixel circuit in all of the sub-frames SF-1 through SF-4.

In an exemplary embodiment, when a data signal is the data signal of the low gray-level region, the method of FIG. 1 may include equally setting the first setting data signal for respective sub-frames. In one exemplary embodiment, for example, as illustrated in FIG. 2, when the 72nd gray-level corresponding to the data signal of the low gray-level region is implemented, the method of FIG. 1 may include applying the first setting data signal corresponding to the 96th gray-level (i.e., the first setting data signal has an equal value) to the pixel circuits in the first sub-frame SF-1, the second sub-frame SF-2 and the third sub-frame SF-3. Thus, in such an embodiment, when the second setting data signal corresponding to the zeroth gray-level is applied to the pixel circuits in the fourth sub-frame SF-4, an average value of respective sub-frame gray-levels may be (96+96+96+0)/4=72. In another exemplary embodiment, when a data signal is the data signal of the low gray-level region, the method of FIG. 1 may include unequally setting the first setting data signal for respective sub-frames. In one exemplary embodiment, for example, when the 72nd gray-level corresponding to the data signal of the low gray-level region is implemented, the method of FIG. 1 may include applying the first setting data signal corresponding to the 90th gray-level to the pixel circuits in the first sub-frame SF-1, applying the first setting data signal corresponding to the 100th gray-level to the pixel circuits in the second sub-frame SF-2, and applying the first setting data signal corresponding to the 98th gray-level to the pixel circuits in the third sub-frame SF-3. Thus, when the second setting data signal corresponding to the zeroth gray-level is applied to the pixel circuits in the fourth sub-frame SF-4, an average value of respective sub-frame gray-levels may be (90+100+98+0)/4=72.

As described above, in such an embodiment of the method shown in FIG. 1, the organic light emitting display device may be driving substantially based on the analog driving technique. In the organic light emitting display device driven by the method of FIG. 1, an image stain related to a relatively low gray-level as well as an image stain related to a relatively high gray-level may be effectively prevented by dividing one frame 1F into one blank frame and a plurality of sub frames SF-1 through SF-4 and by implementing a gray-level corresponding to a data signal using an average value of respective sub frame gray-levels that are displayed in the sub frames SF-1 through SF-4. In such an embodiment, when dividing one frame 1F into one blank frame and a plurality of sub frames SF-1 through SF-4, the number of the sub frames SF-1 through SF-4 may be reduced compared to the digital driving technique as the organic light emitting display device is driven substantially based on the analog driving technique. Thus, the method of FIG. 1 may secure a sufficient timing margin for performing a display operation. Such an embodiment of the method shown in FIG. 1 may allow the organic light emitting display device to display (i.e., output) a high-quality image having a high-resolution by compensating manufacturing deviations or degradations, for example, based on a threshold voltage compensation operation with reference to the data signal of the high gray-level region, and compensating manufacturing deviations or degradations in a time-division manner with reference to the data signal of the low gray-level region. In such an embodiment of the method as shown in FIG. 1, the number of the sub-frames SF-1 through SF-4 may be appropriately determined by allowing for a trade-off relation between a timing margin for performing the display operation and the number of the sub-frames SF-1 through SF-4, such that a data charging issue, which may occur when the threshold voltage compensation operation is performed for the pixel circuits, is effectively prevented.

Figure 3:
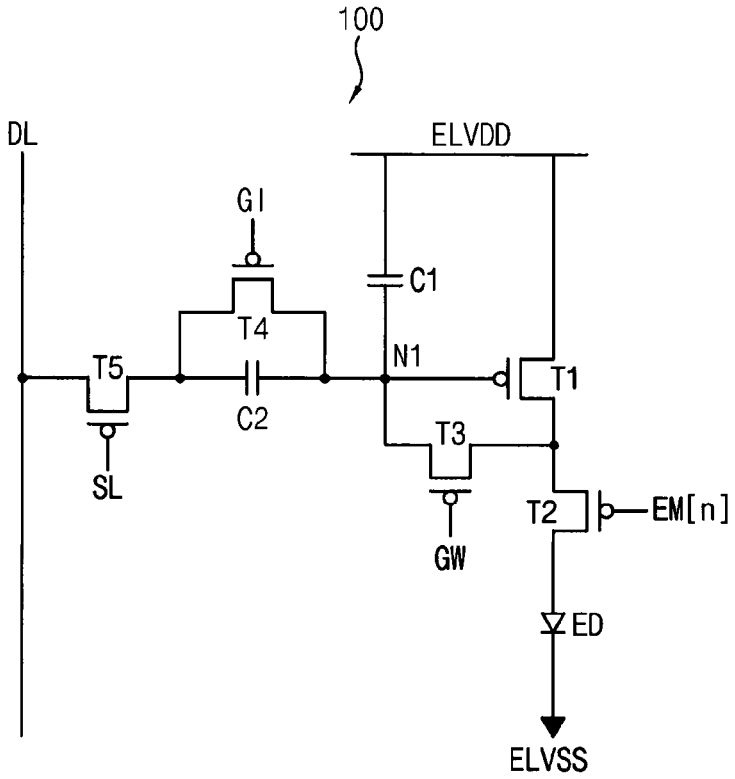
FIG. 3 is a diagram illustrating a pixel circuit in an exemplary embodiment of an organic light emitting display device that employs the method of FIG. 1.

FIG. 3 is a diagram illustrating a pixel circuit in an exemplary embodiment of an organic light emitting display device that employs the method of FIG. 1.

Referring to FIG. 3, the pixel circuit 100 in an exemplary embodiment of an organic light emitting display device may include an organic light emitting diode ED, first through fifth p-channel metal oxide semiconductor ("PMOS") transistors T1 through T5, a first capacitor C1 and a second capacitor C2. In such an embodiment, the pixel circuit 100 may have a five transistors-two capacitors ("5T-2C") structure, that is, a structure including five transistors and two capacitors.

The organic light emitting diode ED may be coupled, e.g., electrically connected, between a low power voltage ELVSS and the first PMOS transistor T1. In such an embodiment, the second PMOS transistor T2 may be coupled between the organic light emitting diode ED and the first PMOS transistor T1. The second PMOS transistor T2 may be referred to as an emission control transistor. The second PMOS transistor T2 may control an emission operation for the pixel circuit 100 in response to an emission control signal EM[n] applied to a gate electrode of the second PMOS transistor T2. In such an embodiment, a cathode of the organic light emitting diode ED may be coupled to the low power voltage ELVSS, and an anode of the organic light emitting diode ED may be coupled to the second PMOS transistor T2. In such an embodiment, a first electrode of the first PMOS transistor T1 may be coupled to a high power voltage ELVDD, a second electrode of the first PMOS transistor T1 may be coupled to the second PMOS transistor T2, and a gate electrode of the first PMOS transistor T1 may be coupled to a first node N1. The first PMOS transistor T1 may be referred to as a driving transistor. The first PMOS transistor T1 may control a current flowing through the organic light emitting diode ED.

The third PMOS transistor T3 may be coupled between the gate electrode (i.e., the first node N1) and the second electrode (e.g., drain electrode) of the first PMOS transistor T1. In such an embodiment, as shown in FIG. 3, a first electrode of the third PMOS transistor T3 may be coupled to the first node N1, a second electrode of the third PMOS transistor T3 may be coupled to the second electrode of the first PMOS transistor T1, and a gate electrode of the third PMOS transistor T3 may receive a first compensation control signal GW. In such an embodiment, the third PMOS transistor T3 may diode-couple the first PMOS transistor T1 in response to the first compensation control signal GW applied to the gate electrode of the third PMOS transistor T3. The first capacitor C1 may be coupled between the high power voltage ELVDD and the first node N1. In such an embodiment, a first electrode of the first capacitor C1 may be coupled to the first node N1, and a second electrode of the first capacitor C1 may be coupled to the high power voltage ELVDD. The first capacitor C1 may be referred to as a storage capacitor. The first capacitor C1 may store a data signal (e.g., an analog driving voltage) applied via a data-line DL when the fifth PMOS transistor T5 is turned on in response to a scan signal applied via a scan-line SL in a scan operation for the pixel circuit 100, and may provide the data signal to the first PMOS transistor T1 (i.e., the driving transistor) in an emission operation for the pixel circuit 100.

The second capacitor C2 and the fourth PMOS transistor T4 may be coupled between the first node N1 and the fifth PMOS transistor T5. In such an embodiment, a first electrode of the second capacitor C2 may be coupled to the first node N1, and a second electrode of the second capacitor C2 may be coupled to the fifth PMOS transistor T5. In such an embodiment, a first electrode of the fourth PMOS transistor T4 may be coupled to the first electrode of the second capacitor C2, a second electrode of the fourth PMOS transistor T4 may be coupled to the second electrode of the second capacitor C2, and a gate electrode of the fourth PMOS transistor T4 may receive a second compensation control signal GI. The second capacitor C2 may be referred to as a threshold voltage compensation capacitor. In such an embodiment, the second capacitor C2 may allow the first node N1 to store the threshold voltage of the first PMOS transistor T1 to compensate a threshold voltage of the first PMOS transistor T1. The first node N1 may be initialized when the fourth PMOS transistor T4 is turned on in response to the second compensation control signal GI while an initialization voltage is applied via the data-line DL, and the first PMOS transistor T1 is diode-coupled in response to the first compensation control signal GW. Subsequently, when the fourth PMOS transistor T4 is turned off in response to the second compensation control signal GI, the threshold voltage of the first PMOS transistor T1 may be compensated because the threshold voltage of the first PMOS transistor T1 is stored in the first node N1 by the second capacitor C2.

The fifth PMOS transistor T5 may be coupled between the data-line DL and the second capacitor C2. In such an embodiment, a first electrode of the fifth PMOS transistor T5 may be coupled to the data-line DL, a second electrode of the fifth PMOS transistor T5 may be coupled to the second capacitor C2, and a gate electrode of the fifth PMOS transistor T5 may be coupled to the scan-line SL. Although a structure of an exemplary embodiment of the pixel circuit 100 is described with reference to FIG. 3, the structure of the pixel circuit 100 in an exemplary embodiment of an organic light emitting display device according to the invention is not limited thereto. In one alternative exemplary embodiment, for example, the pixel circuit 100 may include n-channel metal oxide semiconductor ("NMOS") transistors. In another alternative exemplary embodiment, the pixel circuit 100 may include the NMOS transistors and the PMOS transistors. In some exemplary embodiments, the pixel circuit 100 may have a structure different from the 5T-2C structure (e.g., capacitors and/or transistors are added) as long as the pixel circuit 100 performs the same operation as the above-described operation.

Figure 4:
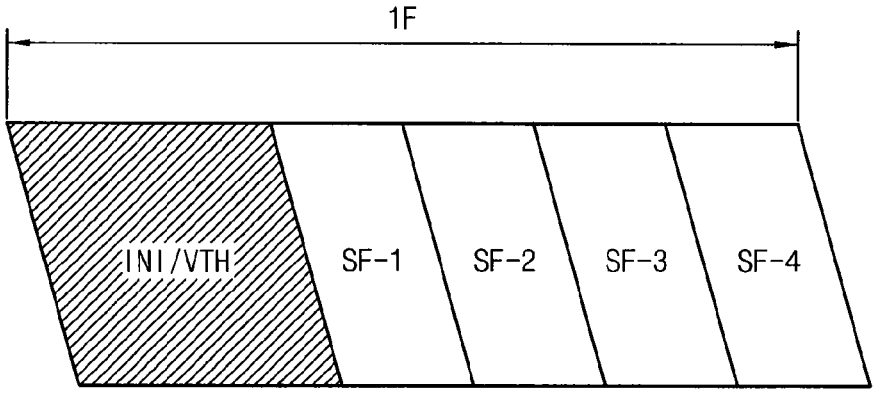
FIG. 4 is a diagram illustrating an exemplary embodiment of an emission operation for pixel circuits, which is performed in a sequential emission manner by the method of FIG. 1.
Figure 5:
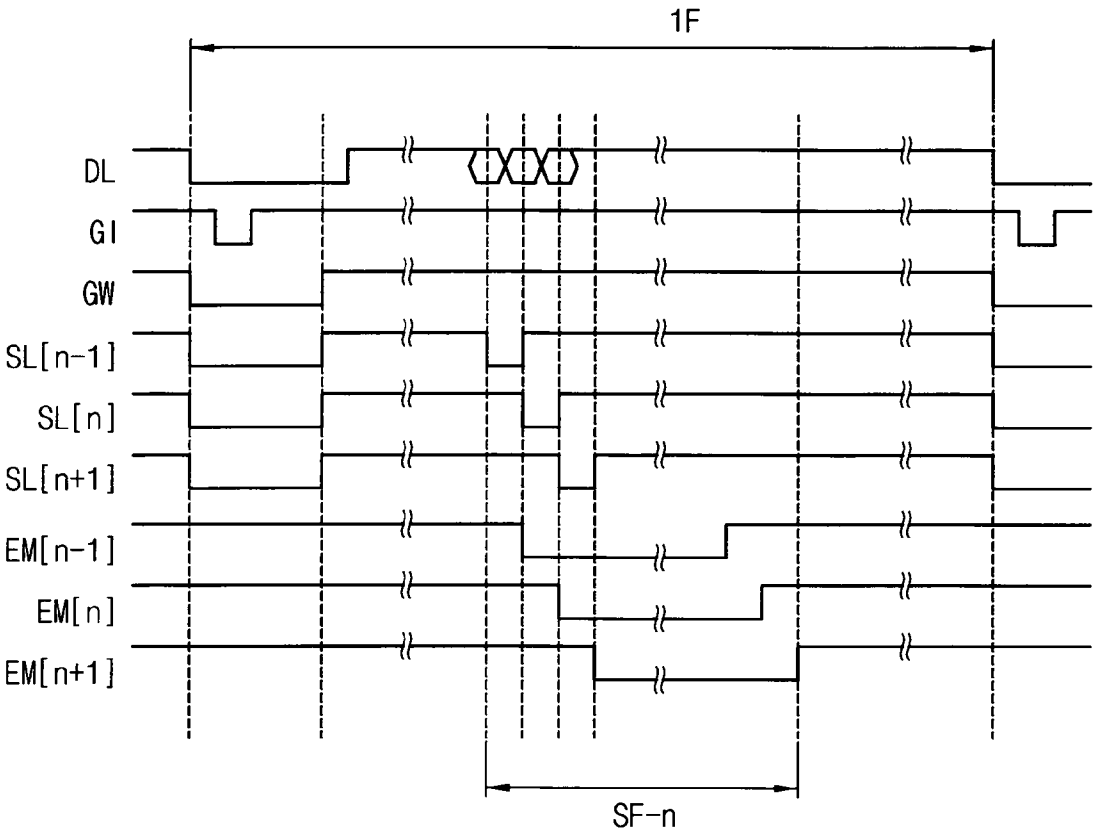
FIG. 5 is a signal timing diagram illustrating signals for an exemplary embodiment of an emission operation of pixel circuits, which is performed in a sequential emission manner by the method of FIG. 1.

FIG. 4 is a diagram illustrating an exemplary embodiment of an emission operation for pixel circuits, which is performed in a sequential emission manner by the method of FIG. 1. FIG. 5 is a signal timing diagram illustrating signals for an exemplary embodiment of an emission operation for pixel circuits, which is performed in a sequential emission manner by the method of FIG. 1.

Referring to FIGS. 4 and 5, the emission operation for the pixel circuits 100 may be performed in the sequential emission manner. As described above, the method of FIG. 1 may include dividing one frame 1F for displaying an image into one blank frame INI/VTH and a plurality of sub-frames SF-1 through SF-4. In such an embodiment, as illustrated in FIG. 4, the blank frame INI/VTH may be arranged prior to the sub-frames SF-1 through SF-4 in one frame 1F. Thus, a scan operation and the emission operation for the pixel circuits 100 may be performed in the sub-frames SF-1 through SF-4 after an initialization operation and a threshold voltage compensation operation for the pixel circuits 100 are performed in the blank frame INI/VTH. As illustrated in FIG. 4, the sub-frames SF-1 through SF-4 may have an equal time length as each other. In an alternative exemplary embodiment, the sub-frames SF-1 through SF-4 may have different time lengths from each other. Hereinafter, for convenience of description, an exemplary embodiment of an organic light emitting display device, where each pixel circuit 100 has the structure of FIG. 3, will be described in detail.

As illustrated in FIG. 5, the initialization operation and the threshold voltage compensation operation for the pixel circuits 100 may be simultaneously performed on all pixel circuits 100 of an exemplary embodiment of an organic light emitting display device in the blank frame INI/VTH. In such an embodiment, scan signals applied via all scan-lines SL[n−1], SL[n] and SL[n+1] may have a logic 'low' level in the blank frame INI/VTH, and thus each fifth PMOS transistor T5 of all pixel circuits 100 of the organic light emitting display device may be turned on. Here, an initialization voltage may be applied via a data-line DL, a first compensation control signal GW may have a logic 'low' level, and thus each third PMOS transistor T3 of all pixel circuits 100 of the organic light emitting display device may be turned on. As a result, each first PMOS transistor T1 of all pixel circuits 100 of the organic light emitting display device may be diode-coupled. When a second compensation control signal GI has a logic 'low' level, each fourth PMOS transistor T4 of all pixel circuits 100 of the organic light emitting display device may be turned on. Therefore, each first node N1 of all pixel circuits 100 of the organic light emitting display device may be initialized, that is, the initialization operation for the pixel circuits 100 may be performed.

Subsequently, when the second compensation control signal GI has a logic 'high' level, each fourth PMOS transistor T4 of all pixel circuits 100 of the organic light emitting display device may be turned off. In such an embodiment, a threshold voltage of each first PMOS transistor T1 of all pixel circuits 100 of the organic light emitting display device may be stored in each first node N1 of all pixel circuits 100 of the organic light emitting display device by each second capacitor C2 of all pixel circuits 100 of the organic light emitting display device. That is, the threshold voltage of each first PMOS transistor T1 of all pixel circuits 100 of the organic light emitting display device may be compensated (i.e., the threshold voltage compensation operation for the pixel circuits 100 may be performed). It is possible that respective blank frames INI/VTH are arranged between the sub-frames SF-1 through SF-4. However, in exemplary embodiments, one blank frame INI/VTH may be arranged prior to the sub-frames SF-1 through SF-4 to secure a sufficient timing margin for performing a display operation. Hence, the initialization operation and the threshold voltage compensation operation for the pixel circuits 100 may be performed once prior to the sub-frames SF-1 through SF-4. The scan operation and the emission operation for the pixel circuits 100 may be performed in the sub-frames SF-1 through SF-4.

Next, as illustrated in FIG. 5, the scan operation and the emission operation for the pixel circuits 100 may be performed in the sub-frames SF-1 through SF-4. In an exemplary embodiment, the scan operation for the pixel circuits 100 may be sequentially performed on horizontal-lines (i.e., scan-lines) coupled to the pixel circuits 100 of the organic light emitting display device in each of the sub-frames SF-1 through SF-4. That is, when the scan operation for the pixel circuits 100 is performed in each of the sub-frames SF-1 through SF-4, a scan signal applied via the (n−1)-th scan-line SL[n−1], a scan signal applied via the n-th scan-line SL[n], and a scan signal applied via the (n+1)-th scan-line SL[n+1] may sequentially have a logic 'low' level. In such an embodiment, the emission operation for the pixel circuits 100 may be sequentially performed on horizontal-lines (i.e., emission control-lines) coupled to the pixel circuits 100 of the organic light emitting display device in each of the sub-frames SF-1 through SF-4. That is, when the emission operation for the pixel circuits 100 is performed in each of the sub-frames SF-1 through SF-4, an emission control signal applied via the (n−1)-th emission control-line EM[n−1], an emission control signal applied via the n-th emission control-line EM[n], and an emission control signal applied via the (n+1)-th emission control-line EM[n+1] may sequentially have a logic 'low' level. As described above, the method of FIG. 1 may include performing the emission operation for the pixel circuits 100 in the sequential emission manner in each of the sub-frames SF-1 through SF-4.

Figure 6:
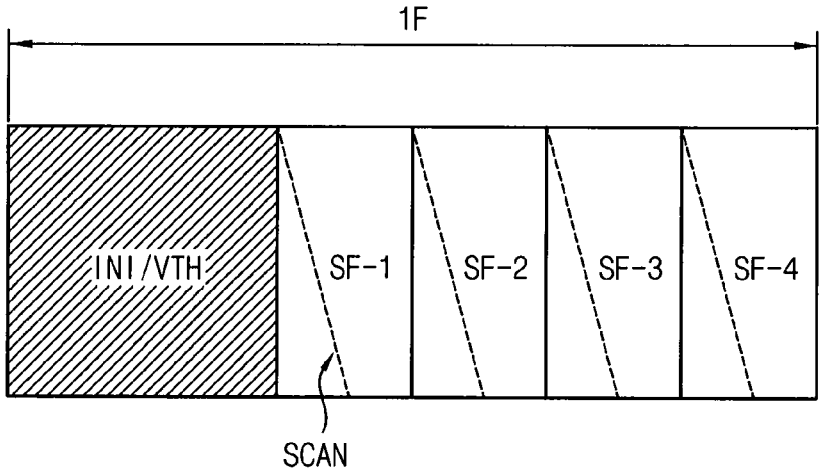
FIG. 6 is a diagram illustrating an exemplary embodiment of an emission operation for pixel circuits, which is performed in a simultaneous emission manner by the method of FIG. 1.
Figure 7:
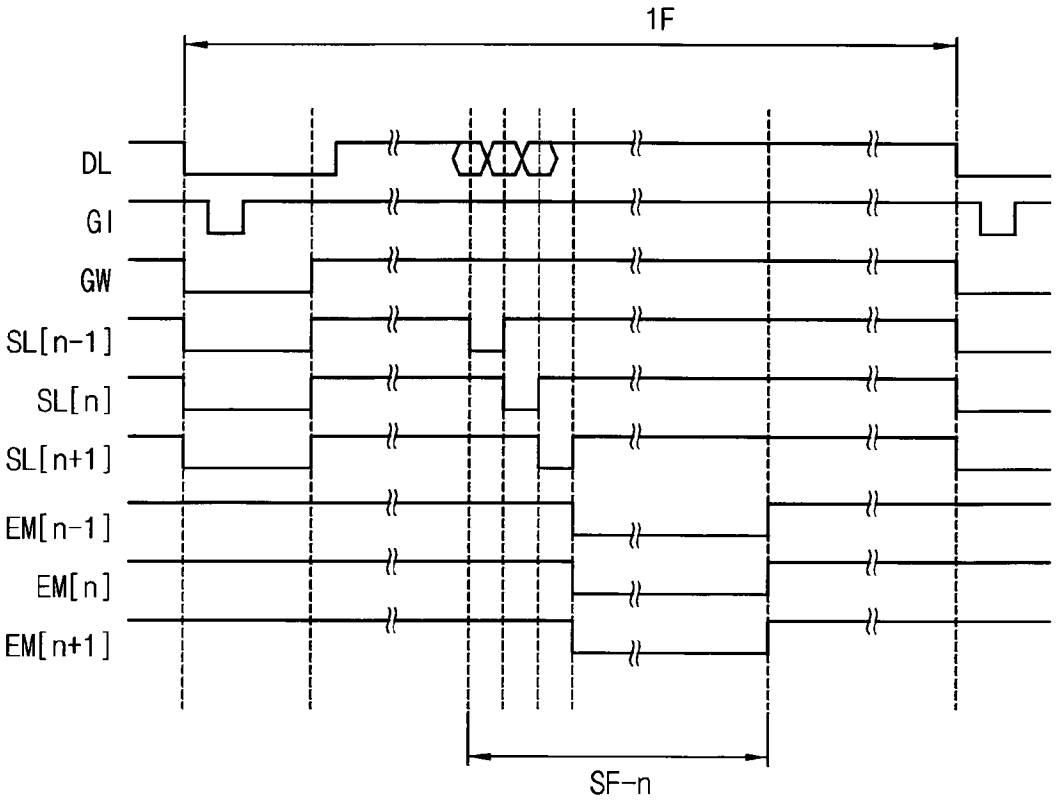
FIG. 7 is a signal timing diagram illustrating signals for an exemplary embodiment of an emission operation for pixel circuits, which is performed in a simultaneous emission manner by the method of FIG. 1.

FIG. 6 is a diagram illustrating an exemplary embodiment of an emission operation for pixel circuits, which is performed in a simultaneous emission manner by the method of FIG. 1. FIG. 7 is a signal timing diagram illustrating signals for an embodiment of an emission operation for pixel circuits, which is performed in a simultaneous emission manner by the method of FIG. 1.

Referring to FIGS. 6 and 7, the emission operation for the pixel circuits 100 may be performed in the simultaneous emission manner. As described above, the method of FIG. 1 may include dividing one frame 1F for displaying an image into one blank frame INI/VTH and a plurality of sub-frames SF-1 through SF-4. In an exemplary embodiment, as illustrated in FIG. 6, the blank frame INI/VTH may be arranged prior to the sub-frames SF-1 through SF-4 in one frame 1F. Thus, a scan operation and the emission operation for the pixel circuits 100 may be performed in the sub-frames SF-1 through SF-4 after an initialization operation and a threshold voltage compensation operation for the pixel circuits 100 are performed in the blank frame INI/VTH. As illustrated in FIG. 6, the sub-frames SF-1 through SF-4 have substantially an equal time length as each other. In an alternative exemplary embodiment, the sub-frames SF-1 through SF-4 may have different time lengths from each other. Hereinafter, for convenience of description, an exemplary embodiment of an organic light emitting display device, where each pixel circuit 100 has the structure of FIG. 3, will be described.

As illustrated in FIG. 7, the initialization operation and the threshold voltage compensation operation for the pixel circuits 100 may be simultaneously performed on all pixel circuits 100 of an organic light emitting display device in the blank frame INI/VTH. Specifically, scan signals applied via all scan-lines SL[n−1], SL[n] and SL[n+1] may have a logic 'low' level in the blank frame INI/VTH, and thus each fifth PMOS transistor T5 of all pixel circuits 100 of the organic light emitting display device may be turned on. Here, an initialization voltage may be applied via a data-line DL, a first compensation control signal GW may have a logic 'low' level, and thus each third PMOS transistor T3 of all pixel circuits 100 of the organic light emitting display device may be turned on. As a result, each first PMOS transistor T1 of all pixel circuits 100 of the organic light emitting display device may be diode-coupled. When a second compensation control signal GI has a logic 'low' level, each fourth PMOS transistor T4 of all pixel circuits 100 of the organic light emitting display device may be turned on. Therefore, each first node N1 of all pixel circuits 100 of the organic light emitting display device may be initialized, that is, the initialization operation for the pixel circuits 100 may be performed.

Subsequently, when the second compensation control signal GI has a logic 'high' level, each fourth PMOS transistor T4 of all pixel circuits 100 of the organic light emitting display device may be turned off. In such an embodiment, a threshold voltage of each first PMOS transistor T1 of all pixel circuits 100 of the organic light emitting display device may be stored in each first node N1 of all pixel circuits 100 of the organic light emitting display device by each second capacitor C2 of all pixel circuits 100 of the organic light emitting display device. That is, the threshold voltage of each first PMOS transistor T1 of all pixel circuits 100 of the organic light emitting display device may be compensated (i.e., the threshold voltage compensation operation for the pixel circuits 100 may be performed). It is possible that respective blank frames INI/VTH are arranged between the sub-frames SF-1 through SF-4. However, in exemplary embodiments, one blank frame INI/VTH may be arranged prior to the sub-frames SF-1 through SF-4 to secure a sufficient timing margin for performing a display operation. Hence, the initialization operation and the threshold voltage compensation operation for the pixel circuits 100 may be performed once prior to the sub-frames SF-1 through SF-4. The scan operation and the emission operation for the pixel circuits 100 may be performed in the sub-frames SF-1 through SF-4.

Next, as illustrated in FIG. 7, the scan operation and the emission operation for the pixel circuits 100 may be performed in the sub-frames SF-1 through SF-4. Here, the scan operation for the pixel circuits 100 may be sequentially performed on horizontal-lines (i.e., scan-lines) coupled to the pixel circuits 100 of the organic light emitting display device in each of the sub-frames SF-1 through SF-4 (i.e., indicated as SCAN in FIG. 6). That is, when the scan operation for the pixel circuits 100 is performed in each of the sub-frames SF-1 through SF-4, a scan signal applied via the (n−1)-th scan-line SL[n−1], a scan signal applied via the n-th scan-line SL[n], and a scan signal applied via the (n+1)-th scan-line SL[n+1] may sequentially have a logic 'low' level. In such an embodiment, the emission operation for the pixel circuits 100 may be simultaneously performed on horizontal-lines (i.e., emission control-lines) coupled to the pixel circuits 100 of the organic light emitting display device in each of the sub-frames SF-1 through SF-4. That is, when the emission operation for the pixel circuits 100 is performed in each of the sub-frames SF-1 through SF-4, an emission control signal applied via the (n−1)-th emission control-line EM[n−1], an emission control signal applied via the n-th emission control-line EM[n], and an emission control signal applied via the (n+1)-th emission control-line EM[n+1] may simultaneously have a logic 'low' level. As described above, the method of FIG. 1 may perform the emission operation for the pixel circuits 100 in the simultaneous emission manner in each of the sub-frames SF-1 through SF-4.

Figure 8:
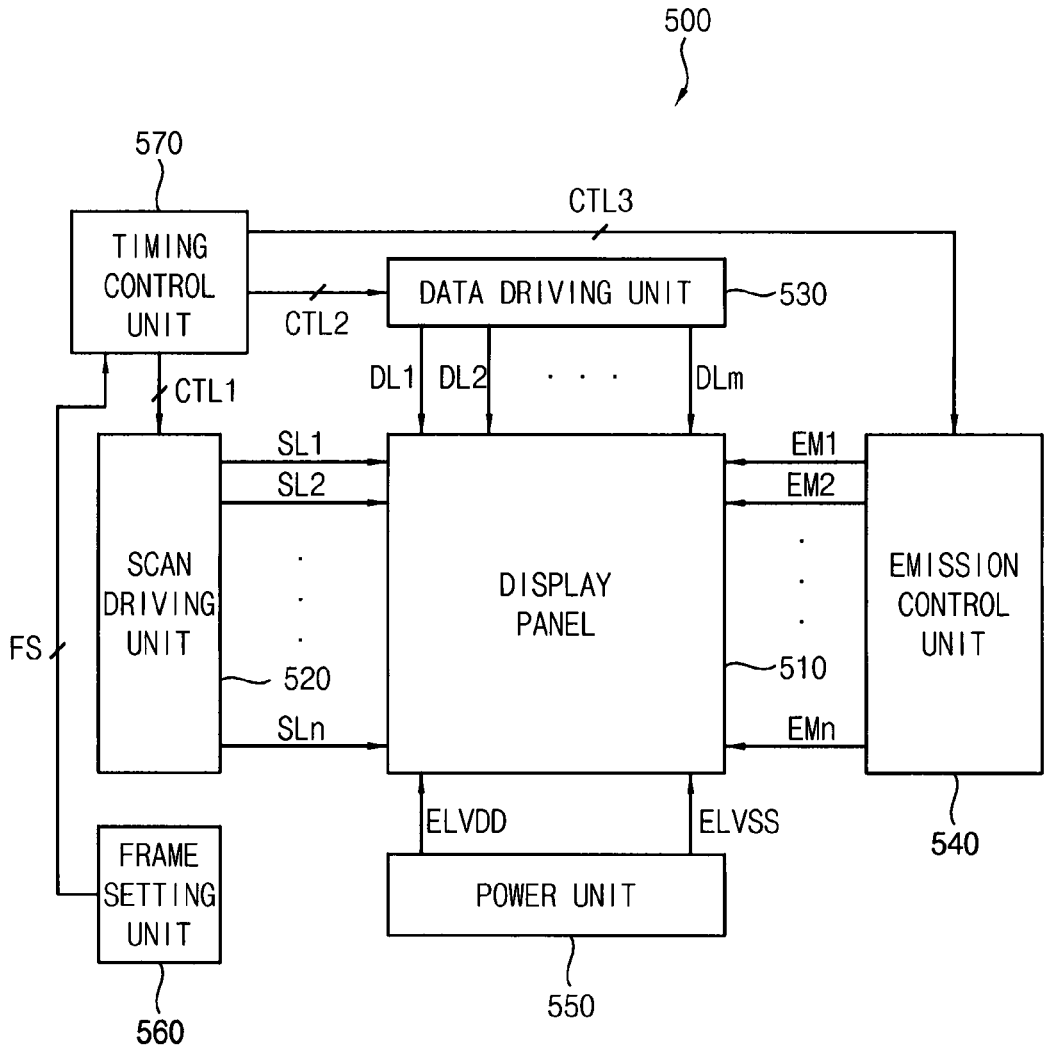
FIG. 8 is a block diagram illustrating an exemplary embodiment of an organic light emitting display device, according to the invention.
Figure 9:
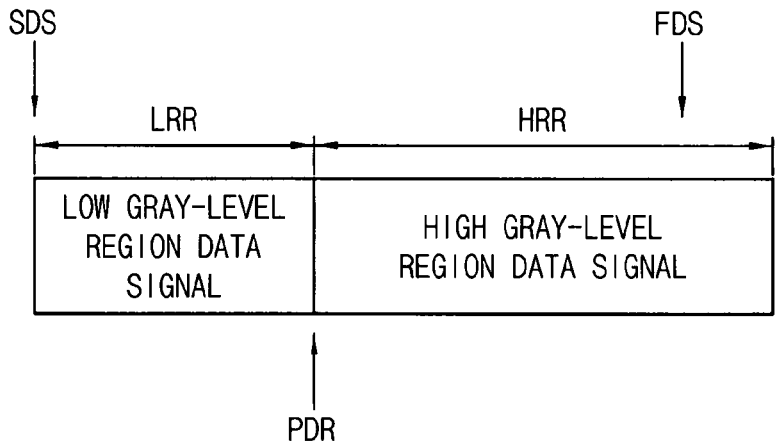
FIG. 9 is a diagram illustrating an exemplary embodiment of a data signal, which is classified into a data signal of a high gray-level region and a data signal of a low gray-level region, in the organic light emitting display device of FIG. 8.
Figure 10:
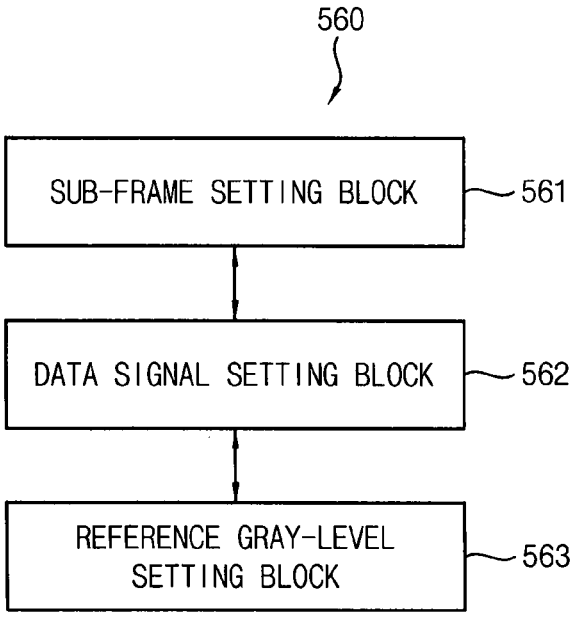
FIG. 10 is a block diagram illustrating an exemplary embodiment of a frame setting unit of the organic light emitting display device of FIG. 8.

FIG. 8 is a block diagram illustrating an exemplary embodiment of an organic light emitting display device, according to the invention. FIG. 9 is a diagram illustrating an exemplary of a data signal, which is classified into a data signal of a high gray-level region and a data signal of a low gray-level region in the organic light emitting display device of FIG. 8. FIG. 10 is a block diagram illustrating an exemplary embodiment of a frame setting unit included in the organic light emitting display device of FIG. 8.

Referring to FIGS. 8 through 10, the organic light emitting display device 500 may include a display panel 510, a scan driving unit 520, a data driving unit 530, an emission control unit 540, a power unit 550, a frame setting unit 560 and a timing control unit 570.

The display panel 510 may include a plurality of pixel circuits. The scan driving unit 520 may provide a scan signal to the pixel circuits via a plurality of scan-lines SL1 through SLn. The data driving unit 530 may provide a data signal to the pixel circuits via a plurality of data-lines DL1 through DLm. The emission control unit 540 may provide an emission control signal to the pixel circuits via a plurality of emission control-lines EM1 through EMn. The power unit 550 may generate a high power voltage ELVDD and a low power voltage ELVSS, and may provide the high power voltage ELVDD and the low power voltage ELVSS to the pixel circuits via a plurality of power-lines. The timing control unit 570 may divide one frame into one blank frame and a plurality of sub-frames, and may control the scan driving unit 520, the data driving unit 530 and the emission control unit 540 to implement (i.e., display) a gray-level corresponding to the data signal using an average value of respective sub-frame gray-levels that are displayed in the sub-frames. For this operation, the timing control unit 570 may generate a plurality of control signals CTL1, CTL2 and CTL3, and may provide the control signals CTL1, CTL2 and CTL3 to the scan driving unit 520, the data driving unit 530 and the emission control unit 540.

As described above, an exemplary embodiment of the organic light emitting display device 500 may fundamentally operate based on an analog driving technique. Here, the organic light emitting display device 500 may effectively prevent an image stain related to a relatively low gray-level as well as an image stain related to a relatively high gray-level by dividing one frame into one blank frame and a plurality of sub-frames, and by implementing a gray-level corresponding to the data signal using an average value of respective sub-frame gray-levels that are displayed in the sub-frames. In such an embodiment, when dividing one frame into one blank frame and a plurality of sub-frames, the organic light emitting display device 500 may reduce the number of the sub-frames compared to a conventional organic light emitting display device that implements a digital driving technique. Thus, the organic light emitting display device 500 may secure a sufficient timing margin for performing a display operation. For this operation, the data driving unit 530 may apply the data signal to the pixel circuits in all of the sub-frames when the data signal is a data signal HRR of a high gray-level region. However, when the data signal is a data signal LRR of a low gray-level region, the data driving unit 530 may apply a first setting data signal FDS corresponding to a gray-level higher than a reference gray-level PDR to the pixel circuits in some of the sub-frames, and may apply a second setting data signal SDS corresponding to the zeroth gray-level to the pixel circuits in other sub-frames among the sub-frames. Here, the reference gray-level PDR may correspond to a reference value that is set by a user (or, designer) to determine whether the data signal is the data signal HRR of the high gray-level region or the data signal LRR of the low gray-level region.

In an exemplary embodiment, to implement (e.g., display) respective sub-frame gray-levels in the sub-frames, the emission control unit 540 may sequentially provide the emission control signal to the pixel circuits in the order of horizontal-lines (i.e., the emission control-lines EM1 through EMn) when an emission operation for the pixel circuits is performed in each of the sub-frames. That is, the emission operation for the pixel circuits may be performed in a sequential emission manner in each of the sub-frames. In another exemplary embodiment, to implement (i.e., display) respective sub-frame gray-levels in the sub-frames, the emission control unit 540 may simultaneously provide the emission control signal to the pixel circuits via the horizontal-lines (i.e., the emission control-lines EM1 through EMn) when the emission operation for the pixel circuits is performed in each of the sub-frames. That is, the emission operation for the pixel circuits may be performed in a simultaneous emission manner in each of the sub-frames.

In an exemplary embodiment, as shown in FIGS. 8 and 9, the frame setting unit 560 may set a time length and a quantity of the sub-frames, the reference gray-level PDR for determining whether the data signal is the data signal HRR of the high gray-level region or the data signal LRR of the low gray-level region, and first and second setting data signals SDS and FDS for the data signal LRR of the low gray-level region, and may provide the timing control unit 570 with a setting signal FS including information related thereto. In an exemplary embodiment, as illustrated in FIG. 10, the frame setting unit 560 may include a sub-frame setting block 561, a data signal setting block 562 and a reference gray-level setting block 563. The sub-frame setting block 561 may set the time length and the quantity of the sub-frames. The data signal setting block 562 may set the first and second setting data signals SDS and FDS for the data signal LRR of the low gray-level region. The reference gray-level setting block 563 may set the reference gray-level PDR for determining whether the data signal is the data signal HRR of the high gray-level region or the data signal LRR of the low gray-level region. However, a structure of the frame setting unit 560 is not limited thereto.

In an exemplary embodiment, the frame setting unit 560 may set respective time lengths of the sub-frames to be substantially equal to each other. In such an embodiment, when a gray-level corresponding to the data signal is implemented using an average value of respective sub-frame gray-levels displayed in the sub-frames, the sub-frames may have an equal weighted value, respectively. In another exemplary embodiment, the frame setting unit 560 may set respective time lengths of the sub-frames to be unequal or to be different from each other. In such an embodiment, when a gray-level corresponding to the data signal is implemented using an average value of respective sub-frame gray-levels displayed in the sub-frames, the sub-frames may have an unequal weighted value, respectively. In one exemplary embodiment, for example, when calculating an average value of respective sub-frame gray-levels displayed in the sub-frames, a sub-frame gray-level displayed in a sub-frame having a relatively long time length may have a relatively large weighted value compared to a sub-frame gray-level displayed in a sub-frame having a relatively short time length. In an exemplary embodiment, when the data signal is the data signal LRR of the low gray-level region, the frame setting unit 560 may equally set the first setting data signal FDS for respective sub-frames. In another exemplary embodiment, when the data signal is the data signal LRR of the low gray-level region, the frame setting unit 560 may unequally set the first setting data signal FDS for respective sub-frames.

In such an embodiment, as described above, the organic light emitting display device 500 may implement a gray-level corresponding to the data signal of the high gray-level region HRR (i.e., a relatively high analog driving voltage) by directly applying the data signal HRR of the high gray-level region to the pixel circuits, and the organic light emitting display device 500 may implement a gray-level corresponding to the data signal LRR of the low gray-level region (i.e., a relatively low analog driving voltage) by not applying the data signal LRR of the low gray-level region to the pixel circuits to effectively prevent an image stain due to the data signal LRR of the low gray-level region. In such an embodiment, the organic light emitting display device 500 may compensate manufacturing deviations or degradations, for example, based on a threshold voltage compensation operation with reference to the data signal HRR of the high gray-level region, and may compensate manufacturing deviations or degradations, for example, in a time-division manner with reference to the data signal LRR of the low gray-level region. As a result, the organic light emitting display device 500 may display (i.e., output) a high-quality image having a high-resolution (i.e., may prevent the image stain related to a relatively low gray-level as well as the image stain related to a relatively high gray-level) while operating based on the analog driving technique.

Figure 11:
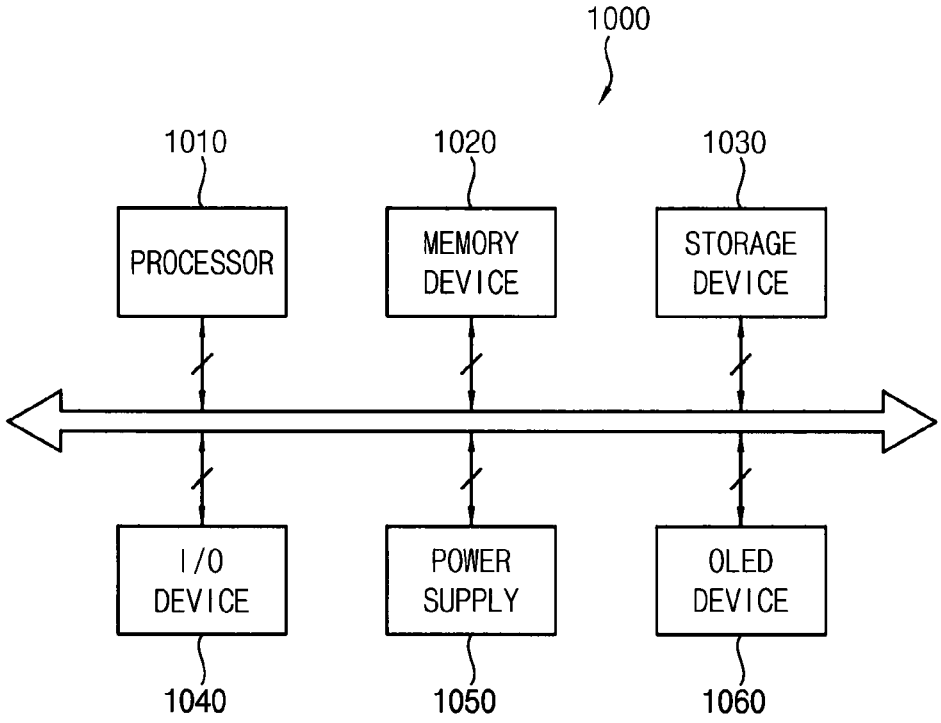
FIG. 11 is a block diagram illustrating an exemplary embodiment of an electronic device, according to the invention.
Figure 12:
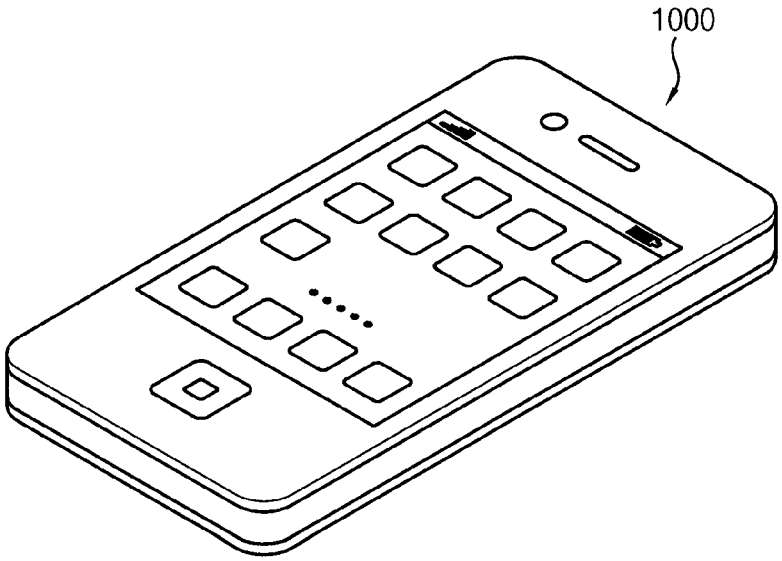
FIG. 12 is a diagram illustrating an exemplary embodiment of the electronic device of FIG. 11, which is implemented as a smart-phone.

FIG. 11 is a block diagram illustrating an exemplary embodiment of an electronic device, according to the invention. FIG. 12 is a diagram illustrating an exemplary embodiment of the electronic device of FIG. 11, which is implemented as a smart-phone.

Referring to FIGS. 11 and 12, the electronic device 1000 may include a processor 1010, a memory device 1020, a storage device 1030, an input/output ("I/O") device 1040, a power supply 1050 and an organic light emitting display ("OLED") device 1060. Here, the OLED device 1060 may correspond to the organic light emitting display device 500 of FIG. 8. In addition, the electronic device 1000 may further include a plurality of ports for communicating a video card, a sound card, a memory card, a universal serial bus ("USB") device or other electronic devices, for example. In some exemplary embodiments, as illustrated in FIG. 12, the electronic device 1000 may be implemented as the smart-phone 1000. However, an implementation of the electronic device 1000 is not limited thereto.

The processor 1010 may perform various computing functions. The processor 1010 may be a micro-processor or a central processing unit ("CPU"), for example. The processor 1010 may be coupled to other components via an address bus, a control bus or a data bus, for example. In such an embodiment, the processor 1010 may be coupled to an extended bus such as a peripheral component interconnection ("PCI") bus. The memory device 1020 may store data for operations of the electronic device 1000. In one exemplary embodiment, for example, the memory device 1020 may include a non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device or a ferroelectric random access memory ("FRAM") device, for example, and/or a volatile memory device such as a dynamic random access memory ("DRAM") device, a static random access memory ("SRAM") device or a mobile DRAM device, for example. The storage device 1030 may be a solid state drive ("SSD") device, a hard disk drive ("HDD") device or a compact disc read-only memory ("CD-ROM") device, for example.

The I/O device 1040 may be an input device such as a keyboard, a keypad, a touchpad, a mouse or a touch-screen, for example, and an output device such as a printer or a speaker, for example. In some exemplary embodiments, the organic light emitting display device 1060 may be included in the I/O device 1040. The power supply 1050 may provide a power for operations of the electronic device 1000. The organic light emitting display device 1060 may communicate with other components via the buses or other communication links. As described above, in such an embodiment, the organic light emitting display device 1060 may operate based on an analog driving technique. However, the organic light emitting display device 1060 may prevent an image stain related to a relatively low gray-level as well as an image stain related to a relatively high gray-level, and may secure a sufficient timing margin for performing a display operation by dividing one frame into one blank frame and a plurality of sub-frames and by implementing a gray-level corresponding to the data signal using an average value of respective sub-frame gray-levels that are displayed in the sub-frames. As a result, the organic light emitting display device 1060 may display (i.e., output) a high-quality image having a high-resolution. In such an embodiment, the organic light emitting display device 1060 may include a display panel having a plurality of pixel circuits, a scan driving unit that provides a scan signal to the pixel circuits, a data driving unit that provides a data signal to the pixel circuits, an emission control unit that provides an emission control signal to the pixel circuits, a power unit that provides a high power voltage and a low power voltage to the pixel circuits, a timing control unit that divides one frame into one blank frame and a plurality of sub-frames, and that controls the scan driving unit, the data driving unit, and the emission control unit to implement a gray-level corresponding to the data signal using an average value of respective sub-frame gray-levels displayed in the sub-frames, and a frame setting unit that sets a time length and a quantity of the sub-frames, a reference gray-level for determining whether the data signal is the data signal of the high gray-level region or the data signal of the low gray-level region, and first and second setting data signals for the data signal of the low gray-level region. The OLED device 1060 shown in FIG. 11 is substantially the same as the OLED device 500 shown in FIG. 8, and any repetitive detailed description thereof will be omitted.

Generally, an image stain due to manufacturing deviations or degradations, for example, may occur in an organic light emitting display device that employs the analog driving technique. Thus, the organic light emitting display device that employs the analog driving technique may perform a threshold voltage compensation operation based on a diode-coupling of the driving transistor, for example. However, since a driving condition of the driving transistor differs between the threshold voltage compensation operation and an emission operation, a threshold voltage may not be properly compensated for a data signal corresponding to a relatively low gray-level while a threshold voltage may be properly compensated for a data signal corresponding to a relatively high gray-level.

That is, in case of the data signal corresponding to a relatively high gray-level, a voltage between a gate electrode and a source electrode of the driving transistor is substantially greater than a threshold voltage compensation error. Thus, an image stain due to the threshold voltage compensation error may not occur. However, in case of the data signal corresponding to a relatively low gray-level, the voltage between the gate electrode and the source electrode of the driving transistor is relatively small, such that an image stain due to the threshold voltage compensation error may occur because an influence of the threshold voltage compensation error is relatively high. Accordingly, in the organic light emitting display device that employs the analog driving technique, an image stain related to a relatively low gray-level may occur.

In an organic light emitting display device that employs the digital driving technique, where a specific gray-level are implemented in a time-division manner by controlling a switching element (e.g., a transistor) to be turned on or turned off based on a digital driving voltage (e.g., 1-bit voltage), an image stain due to manufacturing deviations or degradations, for example, may not occur. However, the organic light emitting display device employing the digital driving technique may divide one frame into a plurality of sub-frames (e.g., 8 to 14 sub-frames are typically used to implement 256 gray-levels). Thus, a timing margin for performing a display operation may be insufficient in the organic light emitting display device that employs the digital driving technique.

In exemplary embodiments of the invention, where the organic light emitting display device is driven based on an analog driving technique, an image stain related to a relatively low gray-level as well as an image stain related to a relatively high gray-level may be effectively prevented, and a sufficient timing margin for performing a display operation may be effectively provided by dividing one frame into one blank frame and a plurality of sub-frames and by implementing a gray-level corresponding to a data signal using an average value of respective sub-frame gray-levels that are displayed in the sub-frames.

In such embodiments, an organic light emitting display device may display (e.g., output) a high-quality image having a high-resolution.

Exemplary embodiments set forth herein may be applied to an electronic device including an organic light emitting display device, e.g., a television, a computer monitor, a laptop, a digital camera, a cellular phone, a smart phone, a personal digital assistant ("PDA"), a portable multimedia player ("PMP"), a MP3 player, a navigation system or a video phone.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A method of driving an organic light emitting display device, the method comprising:

dividing one frame into one blank frame and a plurality of sub-frames;

determining whether a data signal to be applied to a pixel circuit of the organic light emitting display device is a data signal of a high gray-level region or a data signal of a low gray-level region based on a predetermined reference gray-level;

applying the data signal to the pixel circuit in all of the sub-frames when the data signal is the data signal of the high gray-level region; and applying a first setting data signal corresponding to a gray-level higher than the reference gray-level to the pixel circuit in some of the sub-frames, and applying a second setting data signal corresponding to a zeroth gray-level to the pixel circuit in other sub-frames among the sub-frames when the data signal is the data signal of the low gray-level region, wherein the organic light emitting display device implements a gray-level corresponding the data signal by controlling a current flowing through an organic light emitting diode of each pixel circuit thereof based on the data signal, which is an analog driving voltage.

2. The method of claim 1, wherein the gray-level corresponding to the data signal is implemented using an average value of respective sub-frame gray-levels, which are displayed in the sub-frames.

3. The method of claim 2, wherein the first setting data signal is substantially equally set for each of the sub-frames when the data signal is the data signal of the low gray-level region.

4. The method of claim 2, wherein the first setting data signal is unequally set for each of the sub-frames when the data signal is the data signal of the low gray-level region.

5. The method of claim 1, wherein a scan operation and an emission operation for the pixel circuit are performed in the sub-frames.

6. The method of claim 5, wherein the sub-frames have substantially a same time length as each other.

7. The method of claim 5, wherein the sub-frames have different time lengths from each other.

8. The method of claim 5, wherein the emission operation for the pixel circuit is performed in a sequential emission manner in each of the sub-frames.

9. The method of claim 5, wherein the emission operation for the pixel circuit is performed in a simultaneous emission manner in each of the sub-frames.

10. The method of claim 1, wherein an initialization operation and a threshold voltage compensation operation for the pixel circuit are performed in the blank frame.

11. The method of claim 10, wherein the blank frame is arranged prior to the sub-frames in the one frame.

12. An organic light emitting display device comprising:

a display panel comprising a plurality of pixel circuits;

a scan driving unit configured to provide a scan signal to the pixel circuits;

a data driving unit configured to provide a data signal to the pixel circuits;

an emission control unit configured to provide an emission control signal to the pixel circuits;

a power unit configured to provide a high power voltage and a low power voltage to the pixel circuits;

a timing control unit configured to divide one frame into one blank frame and a plurality of sub-frames, and configured to control the scan driving unit, the data driving unit and the emission control unit to implement a gray-level corresponding to the data signal using an average value of respective sub-frame gray-levels displayed in the sub-frames; and a frame setting unit configured to set a time length and a quantity of the sub-frames, a reference gray-level for determining whether the data signal is a data signal of a high gray-level region or a data signal of a low gray-level region, and first and second setting data signals for the data signal of the low gray-level region.

13. The device of claim 12, wherein the data driving unit applies the data signal to the pixel circuits in all of the sub-frames when the data signal is the data signal of the high gray-level region.

14. The device of claim 12, wherein the data driving unit applies the first setting data signal corresponding to a gray-level higher than the reference gray-level to the pixel circuits in some of the sub-frames, and the data driving unit applies the second setting data signal corresponding to a zeroth gray-level to the pixel circuits in other sub-frames among the sub-frames when the data signal is the data signal of the low gray-level region.

15. The device of claim 12, wherein the emission control unit sequentially applies the emission control signal to the pixel circuits when an emission operation for the pixel circuits is performed in each of the sub-frames.

16. The device of claim 12, wherein the emission control unit simultaneously applies the emission control signal to the pixel circuits when an emission operation for the pixel circuits is performed in each of the sub-frames.

17. The device of claim 12, wherein the frame setting unit sets respective time lengths of the sub-frames to be substantially equal to each other.

18. The device of claim 12, wherein the frame setting unit sets respective time lengths of the sub-frames to be unequal to each other.

19. The device of claim 12, wherein the frame setting unit equally sets the first setting data signal for each of the sub-frames when the data signal is the data signal of the low gray-level region.

20. The device of claim 12, wherein the frame setting unit unequally sets the first setting data signal for each of the sub-frames when the data signal is the data signal of the low gray-level region.

* * * * *